US010186745B2

(12) United States Patent
Hsu et al.

(10) Patent No.: US 10,186,745 B2
(45) Date of Patent: Jan. 22, 2019

(54) MILLIMETER WAVE FILTER FINE-TUNING STRUCTURE

(71) Applicant: Universal Microwave Technology, Inc., Keelung (TW)

(72) Inventors: Jung-Chin Hsu, New Taipei (TW); Sheng-Ho Chang, Taichung (TW); Sheng-Feng Yeh, New Taipei (TW); Chun-Kai Wang, Tainan (TW); Wun-Kai Wu, Yilan County (TW); Chun-Yu Chu, Chiayi County (TW); Chun-Wei Chen, New Taipei (TW)

( * ) Notice: Subject to any disclaimer, the term of this patent is extended or adjusted under 35 U.S.C. 154(b) by 77 days.

(21) Appl. No.: 15/430,559

(22) Filed: Feb. 13, 2017

(65) Prior Publication Data

US 2018/0233795 A1 Aug. 16, 2018

(51) Int. Cl.
*H01P 1/205* (2006.01)
*H01P 1/208* (2006.01)

(52) U.S. Cl.
CPC ..... *H01P 1/2053* (2013.01); *H01P 1/2082* (2013.01)

(58) Field of Classification Search
CPC ..... H01P 1/207; H01P 1/208; H01P 1/205; H01P 1/2053; H01P 1/2082
USPC ..... 333/203–205, 208–212
See application file for complete search history.

(56) References Cited

U.S. PATENT DOCUMENTS 5,847,627 A * 12/1998 Radzikowski ..... H01P 5/04 333/202
2007/0139135 A1* 6/2007 Ammar ..... H01P 1/2138 333/135

* cited by examiner

*Primary Examiner* — Rakesh B Patel
*Assistant Examiner* — Jorge L Salazar, Jr.

(57) ABSTRACT

A millimeter wave filter fine-tuning structure includes a resonant cavity, a fine-tuning cavity disposed at the edge of the resonant cavity, a fine-tuning cavity coupled to the resonant cavity, and plural adjusting screws disposed and inserted in the fine-tuning cavity, and the distance between the adjusting screws and the resonant cavity may be used to adjust the resonant frequency of the filter.

9 Claims, 9 Drawing Sheets

MILLIMETER WAVE FILTER FINE-TUNING STRUCTURE

BACKGROUND OF THE INVENTION

Field of the Invention

The present invention relates to a millimeter wave filter fine-tuning structure, in particular to the fine-tuning structure disposed in a resonant cavity of a high-frequency filter and capable of adjusting the resonant frequency of the filter.

Description of Related Art

In conventional manufacturing and electroplating processes of a filter structure, manufacturing machines generally come with a very limited physical tolerance, and thus a resonant cavity structure usually has an error or a deviation, and the actual resonant frequency and a simulated result will be different, and such phenomenon is more obvious in the resonant cavity of a millimeter wave filter. The low-frequency resonant cavity manufactured by the present manufacture precision has a small frequency deviation, but the resonant cavity of the millimeter wave filter manufactured with the present manufacture precision usually has a frequency deviation that requires repeated reworks. Millimeter wave is a very important frequency band in the future 5G market, so that if the resonant cavity has an error and produces a deviation of the resonant frequency, manufacturers will usually require to return the millimeter wave filter to factories for a rework of the resonant cavity structure so as to correct the resonant frequency. In mass production, the products are reworked or scrapped due to an unstable manufacturing process, and a low yield rate is resulted.

In view of the drawbacks of the prior art, the present invention provides a millimeter wave filter fine-tuning structure to overcome the deviation of the resonant frequency caused by the error of the manufacturing machines, so as to improve the yield rate of the mass production. Since the millimeter wave is an important frequency band for the future 5G market, the adjustable mechanism of the millimeter wave filter will be an important method to improve the through rate and yield rate.

SUMMARY OF THE INVENTION

It is a primary objective of the present invention to provide a millimeter wave filter fine-tuning structure, comprising: a resonant cavity; a plurality of fine-tuning cavities, disposed at the edge of the resonant cavity, and coupled to the resonant cavity; and a plurality of adjusting screws, installed in the fine-tuning cavities, and the distance between the adjusting screws and the resonant cavity is used to adjust the resonant frequency of the filter.

Another objective of the present invention is to provide a millimeter wave filter fine-tuning structure, wherein each adjusting screw has a projection area disposed at the resonant cavity.

Another objective of the present invention is to provide a millimeter wave filter fine-tuning structure further comprising a resonant cavity wall disposed at the edge of the resonant cavity and capable of controlling the adjusting screws not to be inserted into the resonant cavity too deep.

Another objective of the present invention is to provide a millimeter wave filter fine-tuning structure further comprising a plurality of sub-resonant cavities extended from both sides of the resonant cavity.

Another objective of the present invention is to provide a millimeter wave filter fine-tuning structure, wherein each adjusting screw a projection area disposed at the sub-resonant cavity.

Another objective of the present invention is to provide a millimeter wave filter fine-tuning structure, wherein the fine-tuning cavities are arranged alternately on both sides of the resonant cavity.

Another objective of the present invention is to provide a millimeter wave filter fine-tuning structure further comprising an equivalent negative capacitance cavity disposed at the center of the edge of the resonant cavity, and the equivalent negative capacitance cavity being a fixed structure.

Another objective of the present invention is to provide a millimeter wave filter fine-tuning structure, wherein the fine-tuning cavities is in a shape of a cylindrical column, a square column, a polygonal column, or an irregular column.

Another objective of the present invention is to provide a millimeter wave filter fine-tuning structure, wherein the adjusting screws are made of metal.

Another objective of the present invention is to provide a millimeter wave filter fine-tuning structure, wherein the adjusting screws have a surface coated with metal.

BRIEF DESCRIPTION OF THE DRAWINGS

FIG. 1-2 is a side view of a millimeter wave filter fine-tuning structure in accordance with an embodiment of the present invention;

FIG. 1-3 is a top view of a millimeter wave filter fine-tuning structure in accordance with an embodiment of the present invention;

FIG. 2-1 is a cross-sectional view of a millimeter wave filter fine-tuning structure in accordance with another embodiment of the present invention;

FIG. 2-2 is a side view of a millimeter wave filter fine-tuning structure in accordance with another embodiment of the present invention;

FIG. 2-3 is a bottom view of a millimeter wave filter fine-tuning structure in accordance with another embodiment of the present invention;

FIG. 2-4 is a top view of a millimeter wave filter fine-tuning structure in accordance with another embodiment of the present invention;

FIG. 2-5 is a simulated frequency chart of a millimeter wave filter fine-tuning structure in accordance with another embodiment of the present invention; and FIG. 2-6 is an actual S parameter measured chart of a millimeter wave filter fine-tuning structure in accordance with another embodiment of the present invention.

DESCRIPTION OF THE INVENTION

The aforementioned and other objects, characteristics and advantages of the present invention will become apparent with the detailed description of the preferred embodiments and the illustration of related drawings as follows.

Figure 1:
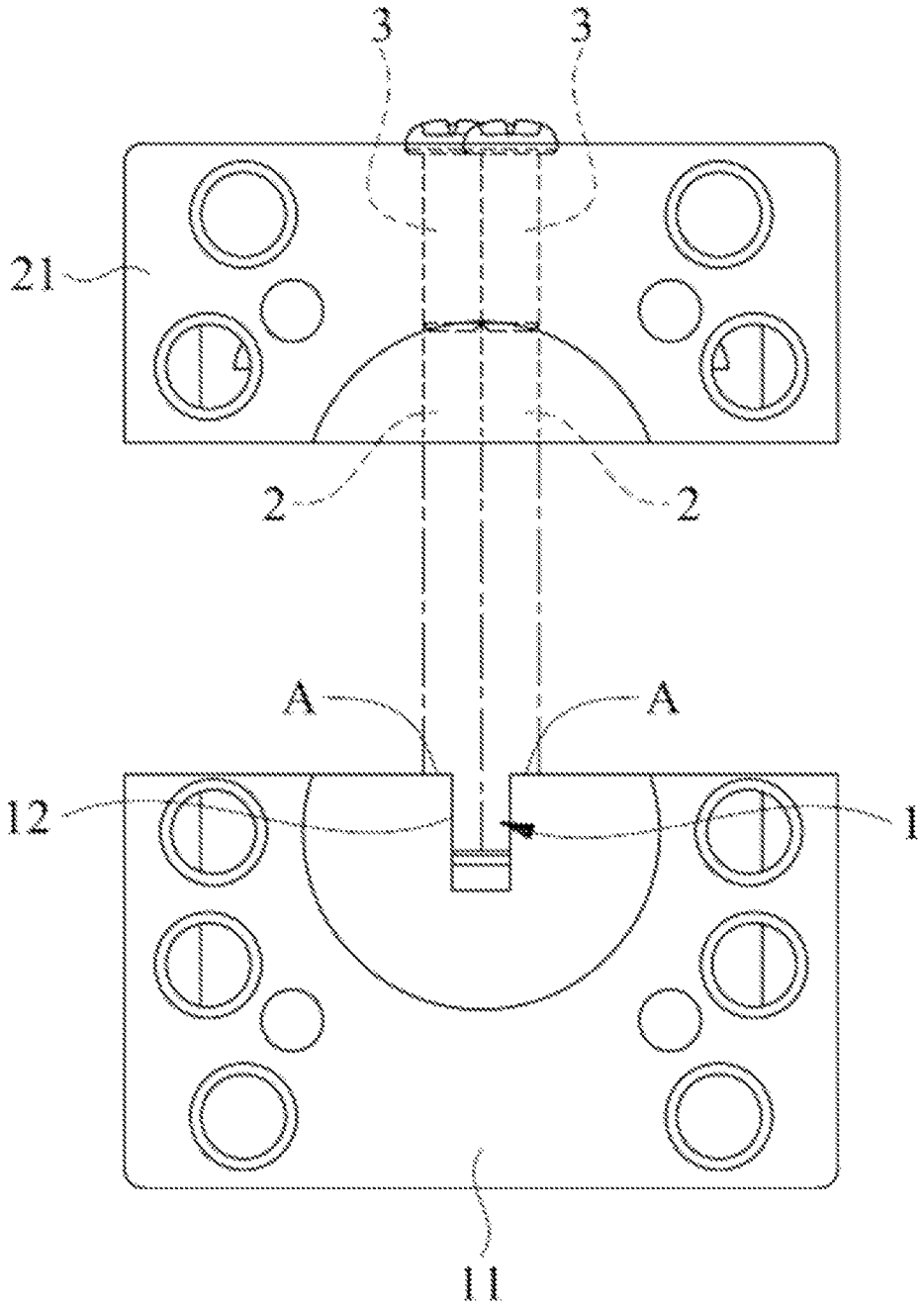
FIG. 1-1 is a cross-sectional view of a millimeter wave filter fine-tuning structure in accordance with an embodiment of the present invention.
Figures 1, 2:
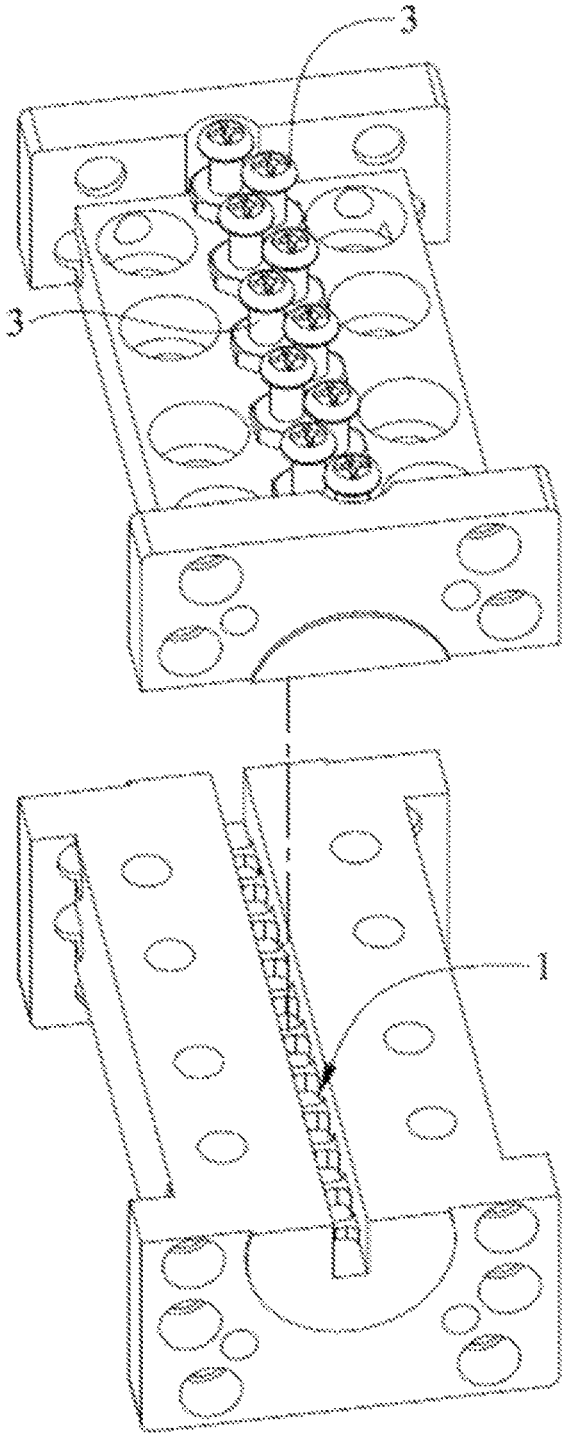
Figures 1, 2, 3:
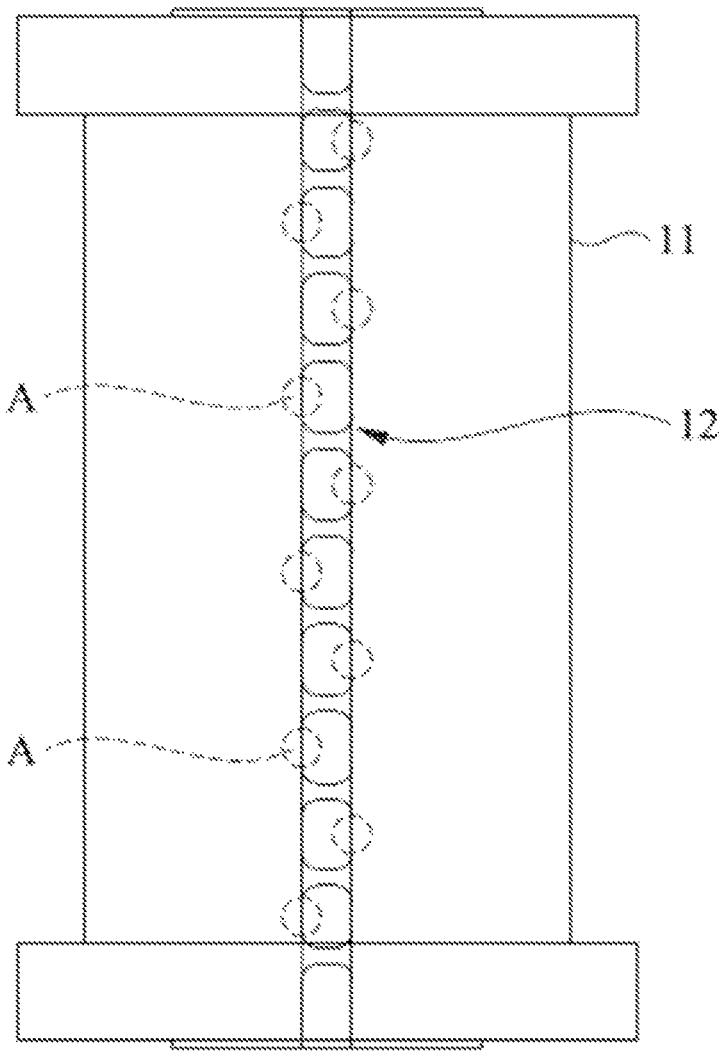
Figures 1, 2:
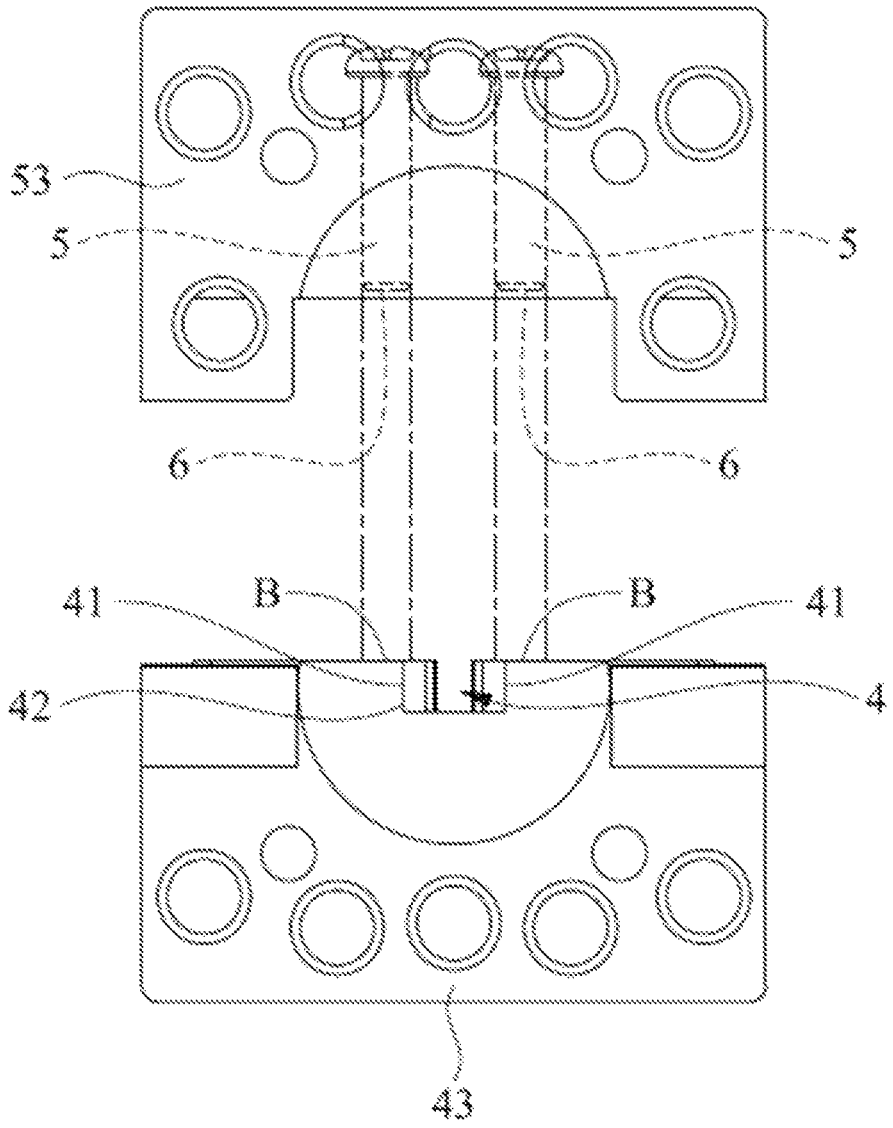
Figure 2:
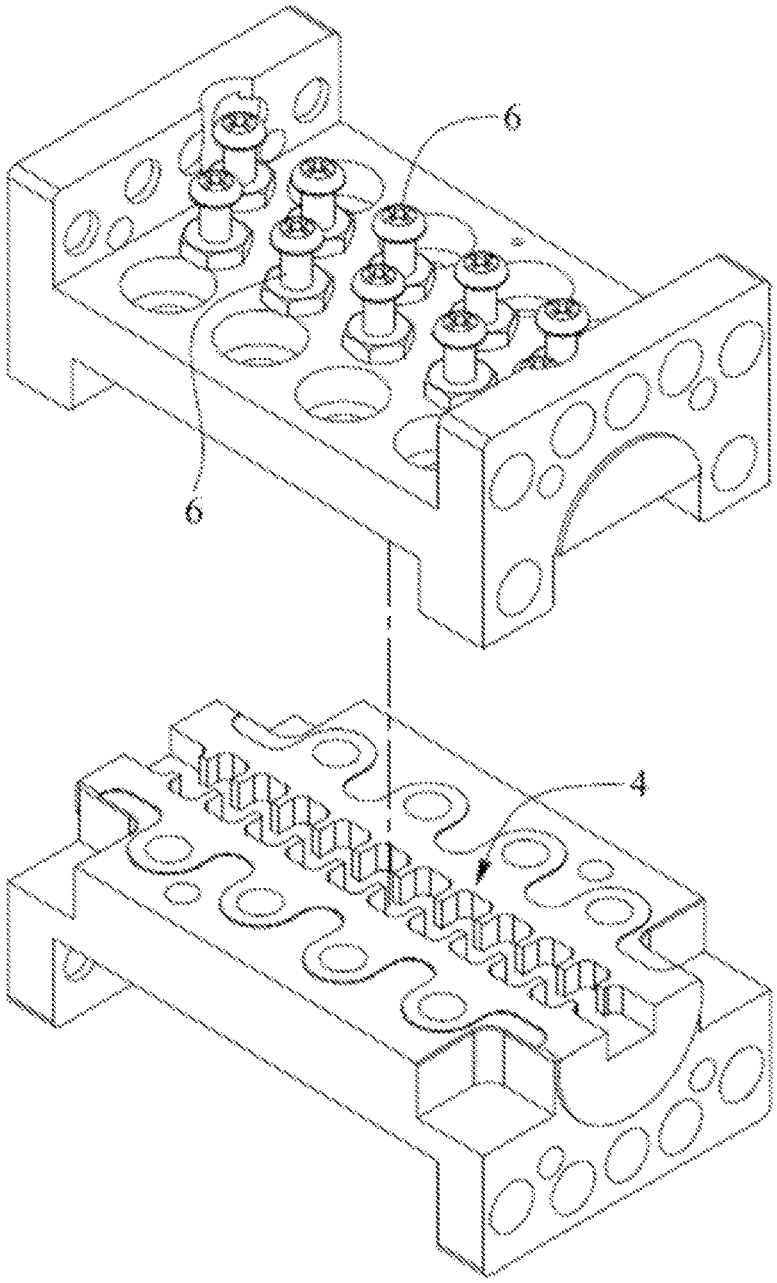
Figures 2, 3:
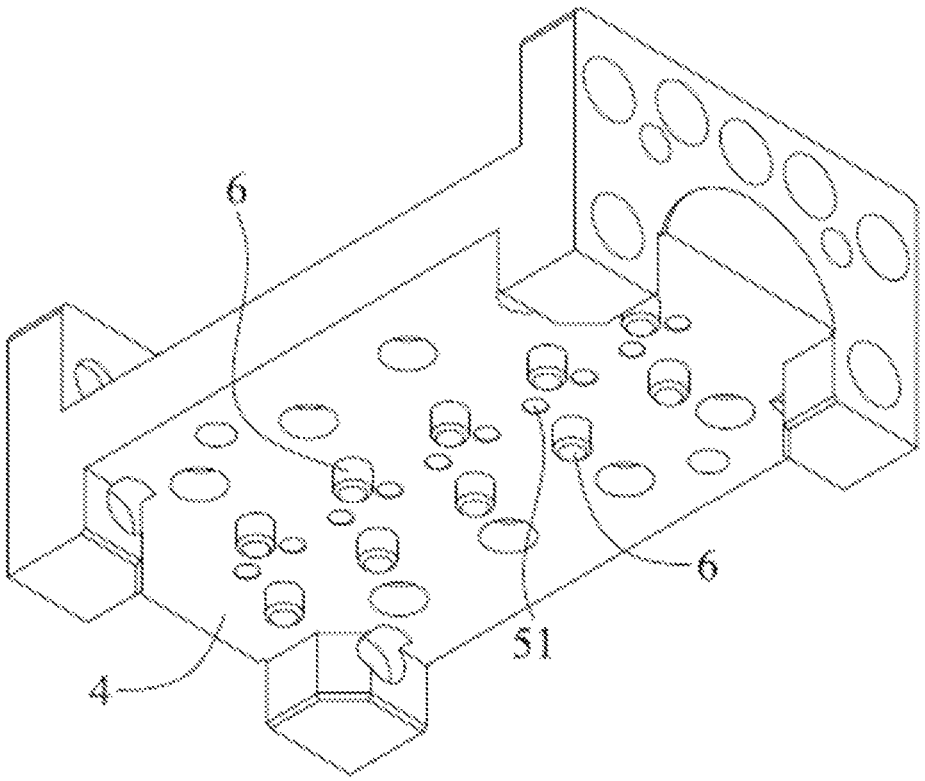
Figures 2, 3, 4:
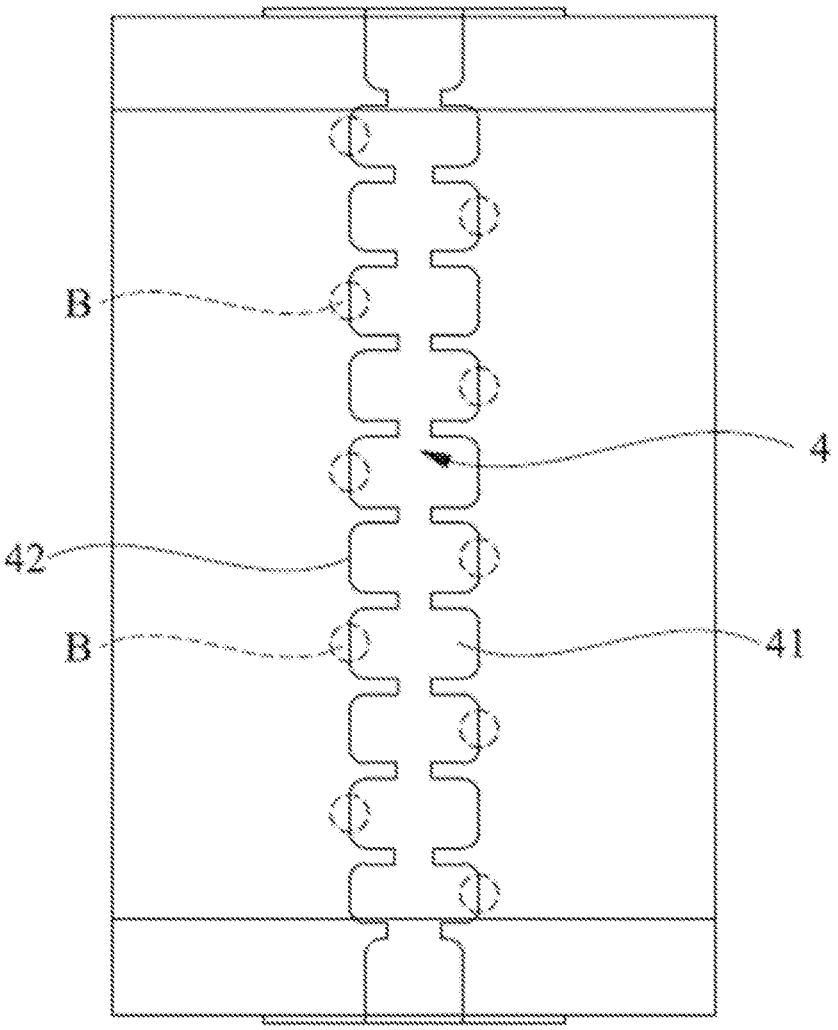
Figures 2, 3, 4, 5:
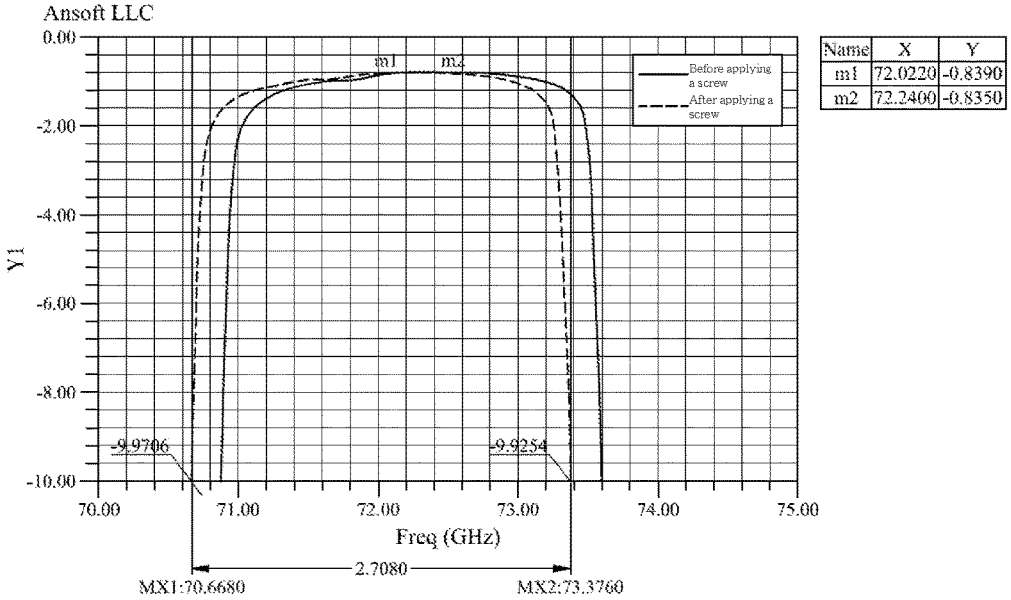
Figures 2, 3, 4, 5, 6:
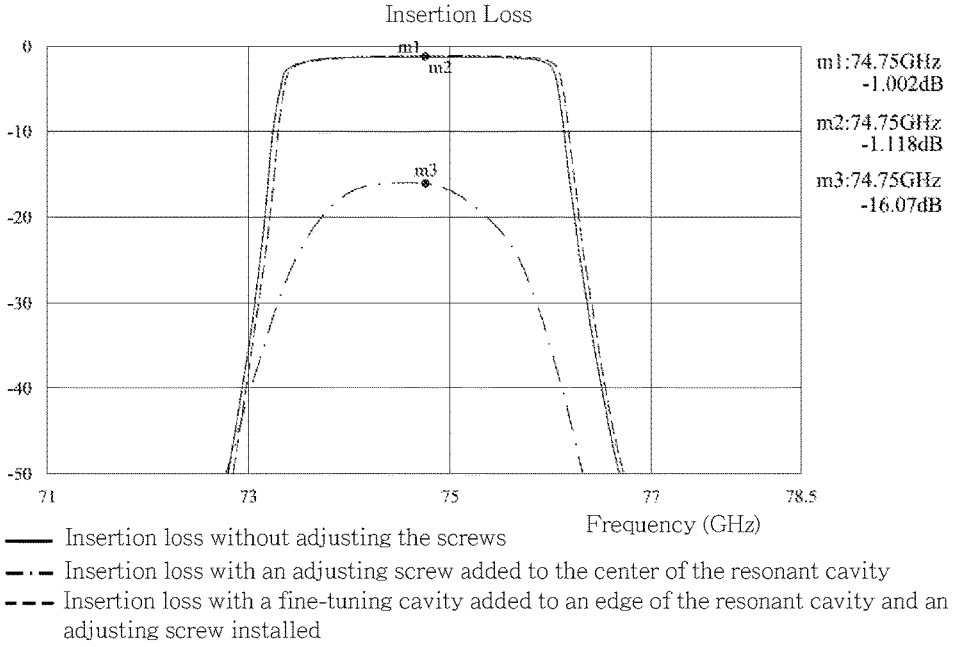

With reference to FIGS. 1-1 to 1-3 for a cross-sectional view, a side view and a top view of a millimeter wave filter fine-tuning structure in accordance with a preferred embodiment of the present invention respectively, the millimeter wave filter fine-tuning structure comprises a resonant cavity 1, a fine-tuning cavity 2 and a plurality of adjusting screws 3. Wherein, the resonant cavity 1 is disposed in a lower housing 11, and the fine-tuning cavity 2 is disposed in an upper housing 21. The fine-tuning cavity 2 is disposed at the edge of the resonant cavity 1 and coupled to the resonant cavity 1. The fine-tuning cavity 2 has a plurality of adjusting screws 3, and the distance between the plurality of adjusting screws 3 and the resonant cavity 1 is provided for adjusting the resonant frequency of the filter. The structure of the fine-tuning cavity 2 is in the shape of a cylindrical column, a square column, a polygonal column, or an irregular column. In FIG. 1-1, each adjusting screw 3 has a projection area A disposed in the resonant cavity 1, and the edge of the adjusting screw 3 is limited by a resonant cavity wall 12, so that the adjusting screw 3 will not penetrate into the resonant cavity 1 too deep. When the adjusting screws 3 are used in the fine-tuning cavity 2 for a fine-tune operation, the frequency can be adjusted effectively without causing a large insertion loss. When the resonant cavity 1 has a deviation of resonant frequency due to the manufacturing error, it no longer requires a rework in the factory since there is a fine-tuning structure at the edge of the resonant cavity 1. Since the high-frequency filter has a high resonant frequency, a small error of the fine structure will cause a deviation of frequency, particularly in the millimeter wave. Since the adjusting screws 3 are situated at the edge of the resonant cavity 1 for adjusting the frequency, the distance between the screws and the resonant cavity 1 is greater. Because of that, when the adjusting screws 3 are used for the fine-tune operation, a production worker can adjust the frequency accurately. Wherein, the adjusting screws 3 are arranged alternately at the edge of the resonant cavity 1, so that the area occupied by the fine-tuning cavity 2 in the resonant cavity 1 is reduced. However, the invention is not limited to such arrangement only. Since the adjusting screws 3 are distributed along the edge of the resonant cavity 1, the adjusting position can be adjusted according to the required resonant frequency, and the deviation of the resonant frequency caused by the error or damage of the structure can be adjusted easily, and the manufacturing capability can be improved. Wherein, the adjusting screw 3 is made of metal such as stainless steel copper, gold, silver, iron, titanium, or their alloys. The adjusting screw 3 may be plated with a metal film, and the adjusting screws are made of metal such as stainless steel, copper, gold, silver, iron, titanium, or their alloys. The adjusting screw 3 may have a cross-section in the shape of a circle, a square, or a polygon.

With reference to FIGS. 2-1 to 2-4 for a cross-sectional view, a side view, a bottom view and a top view of another preferred embodiment of the present invention respectively, the millimeter wave filter fine-tuning structure comprises an upper housing 53, a lower housing 43, a resonant cavity 4, a sub-resonant cavity 41, a sub-resonant cavity wall 42, a fine-tuning cavity 5, an equivalent negative capacitance cavity 51 and a plurality of adjusting screws 6. Wherein, the resonant cavity 4 is disposed in a lower housing 43, and the fine-tuning cavity 5 is disposed in an upper housing 53, and the upper housing 43 and the lower housing 53 are engaged with each other. The sub-resonant cavity 41 is extended from both sides of the resonant cavity 4, and the fine-tuning cavity 5 is disposed at the edge of the sub-resonant cavity 41 and coupled to the sub-resonant cavity 41. The fine-tuning cavity 5 has a plurality of adjusting screws 6, and the distance between the plurality of adjusting screws 6 and the resonant cavity 4 is used to adjust the resonant frequency of the filter. The structure of the fine-tuning cavity 5 is in the shape of a cylindrical column, a square column, a polygonal column, or an irregular column. In FIG. 2-1, each adjusting screw 6 has a projection area B disposed at the edge of the sub-resonant cavity 41, and the edge of the adjusting screw 6 is limited by the sub-resonant cavity wall 42, so that the adjusting screw 6 will not penetrate into the sub-resonant cavity 41 too deep. Since the sub-resonant cavity 41 is extended from both sides of the resonant cavity 4, the frequency can be adjusted effectively when the adjusting screws 6 are used for a fine-tune operation in the fine-tuning cavity 5 and a large insertion loss can be prevented. For example, according to simulated data shown in FIG. 2-5, the plurality of adjusting screws 6 will not penetrate too deep into the fine-tuning cavity 5, so that the frequency shifts to high frequency, and the center frequency shifts from 72.022 GHz to 72.24 GHz to a high frequency of 218 MHz, and the insertion loss drops from −0.839 dB to −0.835 dB, and there is just a loss of +0.004 dB, or no substantial loss or change occurs. With reference to FIG. 2-6 for a comparison of simulating the fine-tuning cavity 5 disposed at the center of the resonant cavity 4 and the fine-tuning cavity 5 disposed on both sides of the sub-resonant cavity 41, if the adjusting screw 6 is arranged at the center of the resonant cavity 4, the insertion loss will be increased drastically and the filter cannot be used, and the adjusting screws 6 arranged on both sides of the sub-resonant cavity 41 will not cause any significant loss. Therefore, the structure of the present invention has a substantial effect. The equivalent negative capacitance cavity 51 is disposed in the upper housing 53 and the center of the upper edge of the resonant cavity 4 and coupled to the resonant cavity 51. Since the structure of the fine-tuning cavity 5 causes a resonance to shift the frequency to a low frequency, it is necessary to provide the equivalent negative capacitance cavity 51 to adjust the resonant frequency. The structure of the equivalent negative capacitance cavity 51 is in the shape of a cylindrical column, a square column, a polygonal column, or an irregular column. During mass production, the resonant cavity 4 may have a deviation of resonant frequency caused by manufacturing errors, and the edge of the sub-resonant cavity 41 has a fine-tuning structure with a plurality of adjusting screws 6, so that it is not necessary to send the millimeter wave filter back to factory for a rework, so as to reduce the loss of manufacturing labor and time. Since the high-frequency filter has a high resonant frequency, a small structural error may cause a deviation of frequency easily, particularly in the millimeter wave. The adjusting screws 6 at the edge of the sub-resonant cavity 41 are provided for making adjustments. Since the distance from the center of the resonant cavity 4 is greater, when the adjusting screws 6 are used for a fine-tune operation, a production worker can adjust the frequency accurately. Wherein, the fine-tuning cavities 5 are arranged alternately along the edge of the sub-resonant cavity 41 to meet the requirement for a compact resonant cavity 4 of the millimeter wave filter. However, the present invention is not limited to such arrangement only. Since the adjusting screws 6 are distributed along the edge of the sub-resonant cavity 41, the adjusting position can be adjusted according to the required resonant frequency, and the deviation of resonant frequency caused by the structural error or damage can be adjusted easily, and the manufacturing capability can be improved. The adjusting range of the adjusting screw 6 covers the interior of the fine-tuning cavity 5. The adjusting screws 6 are made of metal such as stainless steel, copper, gold, silver, iron, titanium, or their alloys. The adjusting screw 6 may be plated with a metal film, and the adjusting screws 6 are made of metal such as stainless steel, copper, gold, silver, iron, titanium, or their alloys. The adjusting screw 6 has a cross-section in the shape of a circle, a square, or a polygon.

While the invention has been described by means of specific embodiments, numerous modifications and variations could be made thereto by those skilled in the art without departing from the scope and spirit of the invention set forth in the claims.

What is claimed is:

1. A millimeter wave filter fine-tuning structure, comprising:

a resonant cavity;

a plurality of fine-tuning cavities, disposed at an edge of the resonant cavity, and coupled to the resonant cavity;

a plurality of adjusting screws, installed in the fine-tuning cavities, and the distance between the adjusting screws and the resonant cavity is used to adjust a resonant frequency of the filter; and a resonant cavity wall disposed at the edge of the resonant cavity and capable of controlling the adjusting screws not to be inserted into the resonant cavity too deep.

2. The millimeter wave filter fine-tuning structure according to claim 1, wherein each of the plurality of adjusting screws has a part of a projection area disposed at the resonant cavity.

3. The millimeter wave filter fine-tuning structure according to claim 1, wherein the plurality of adjusting screws have a surface coated with metal.

4. The millimeter wave filter fine-tuning structure according to claim 1, wherein the resonant cavity further has a plurality of sub-resonant cavities extended from two sides of the resonant cavity.

5. The millimeter wave filter fine-tuning structure according to claim 1, wherein each of the plurality of adjusting screws has a part of a projection area disposed at the corresponding sub-resonant cavity.

6. The millimeter wave filter fine-tuning structure according to claim 1, wherein the fine-tuning cavities are arranged alternately on both sides of the resonant cavity.

7. The millimeter wave filter fine-tuning structure according to claim 1, further comprising an equivalent negative capacitance cavity disposed at a center of the edge of the resonant cavity, and the equivalent negative capacitance cavity being a fixed structure.

8. The millimeter wave filter fine-tuning structure according to claim 1, wherein the fine-tuning cavities is in a shape of a cylindrical column, a square column, a polygonal column, or an irregular column.

9. The millimeter wave filter fine-tuning structure according to claim 1, wherein the plurality of adjusting screws are made of metal.

* * * * *